US009608388B2

(12) United States Patent
Kondo et al.

(10) Patent No.: US 9,608,388 B2
(45) Date of Patent: Mar. 28, 2017

(54) CONNECTOR

(71) Applicant: FUJITSU COMPONENT LIMITED, Tokyo (JP)

(72) Inventors: Takahiro Kondo, Tokyo (JP); Koki Sato, Tokyo (JP); Mitsuru Kobayashi, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/054,229

(22) Filed: Feb. 26, 2016

(65) Prior Publication Data

US 2016/0261080 A1 Sep. 8, 2016

(30) Foreign Application Priority Data

Mar. 3, 2015 (JP) ..... 2015-041571

(51) Int. Cl.

| | |
|---|---|
| ***H01R 24/40*** | (2011.01) |
| ***H01R 13/514*** | (2006.01) |
| ***H01R 24/38*** | (2011.01) |
| ***H01R 12/70*** | (2011.01) |
| ***H01R 12/72*** | (2011.01) |
| ***H01R 13/432*** | (2006.01) |
| *H01R 12/71* | (2011.01) |
| *H01R 13/11* | (2006.01) |
| *H01R 24/52* | (2011.01) |
| *H01R 13/512* | (2006.01) |

(52) U.S. Cl.

CPC ..... *H01R 24/38* (2013.01); *H01R 12/7047* (2013.01); *H01R 12/721* (2013.01); *H01R 12/722* (2013.01); *H01R 13/432* (2013.01); *H01R 12/714* (2013.01); *H01R 13/11* (2013.01); *H01R 13/512* (2013.01); *H01R 24/52* (2013.01)

(58) Field of Classification Search

CPC .. H01R 2103/00; H01R 24/40; H01R 13/514; H01R 13/41; H01R 24/38

USPC ..... 439/579, 578, 751, 701

See application file for complete search history.

(56) References Cited

U.S. PATENT DOCUMENTS

| | | | | |
|---|---|---|---|---|
| 4,996,478 A | | 2/1991 | Pope | |
| 5,354,219 A | * | 10/1994 | Wanjura | H01R 13/6599 439/607.12 |
| 6,080,023 A | | 6/2000 | Meulemeester et al. | |
| 6,926,553 B2 | * | 8/2005 | Wu | H01R 9/0515 439/497 |

(Continued)

FOREIGN PATENT DOCUMENTS

| | | |
|---|---|---|
| EP | 0948102 | 10/1999 |
| JP | 2004-304313 | 10/2004 |

(Continued)

*Primary Examiner* — Gary Paumen
(74) *Attorney, Agent, or Firm* — IPUSA, PLLC

(57) ABSTRACT

A connector includes a contact that has a first end provided with a contact point for connecting to a coaxial cable, and a second end provided with a terminal for connecting to a substrate, a body that includes a contact mount to which the contact is mounted and a substrate mount to which the substrate is mounted, and a bracket attached to the substrate mount, that holds the substrate and includes a slot into which the terminal is inserted. The bracket is detachably attached to the body, and the terminal applies pressure to the substrate and contacts the substrate by mounting the bracket to the body.

5 Claims, 16 Drawing Sheets

(56) References Cited

U.S. PATENT DOCUMENTS

| | | | | |
|---|---|---|---|---|
| 6,947,011 | B2 | 9/2005 | Kukita et al. | |
| 7,980,893 | B2 * | 7/2011 | Sato | H01R 24/50 439/578 |
| 8,558,568 | B2 * | 10/2013 | Uesaka | G01R 1/0416 324/754.08 |
| 2004/0266273 | A1 * | 12/2004 | Wu | H01R 13/514 439/701 |
| 2011/0028033 | A1 | 2/2011 | Sato et al. | |
| 2011/0117779 | A1 * | 5/2011 | Feldman | H01R 9/0512 439/578 |
| 2011/0285415 | A1 | 11/2011 | Uesaka et al. | |

FOREIGN PATENT DOCUMENTS

| | | |
|---|---|---|
| JP | 2008-270107 | 11/2008 |
| JP | 2014-056758 | 3/2014 |
| WO | 2010/042579 | 4/2010 |

* cited by examiner

23

CONNECTOR

CROSS-REFERENCE TO RELATED APPLICATIONS

This application is based upon and claims the benefit of priority of prior Japanese Patent Application No. 2015-041571 filed on Mar. 3, 2015, the entire contents of which are hereby incorporated by reference.

BACKGROUND

1. Field of the Invention

The present invention relates to a connector mounted to a substrate.

2. Description of the Related Art

A coaxial cable is used for transmitting signals. The coaxial cable includes a center conductor and an external conductor that are concentrically provided therein.

When connecting the coaxial cable to a substrate, a cable connector attached to the coaxial cable is connected to a substrate connector attached to the substrate.

The substrate connector includes a terminal that connects with the substrate. The terminal is fixed and connected to the substrate by soldering.

[Patent Document 1]: Japanese Laid-Open Patent Publication No. 2004-304313

However, once the terminal is soldered to the substrate, it is difficult to detach the connector from the substrate.

Thus, one object of the prevent invention is to provide a connector that can be easily detachably attached to the substrate.

SUMMARY

An embodiment of the present invention provides a connector that includes a contact that has a first end provided with a contact point for connecting to a coaxial cable, and a second end provided with a terminal for connecting to a substrate, a body that includes a contact mount to which the contact is mounted and a substrate mount to which the substrate is mounted, and a bracket attached to the substrate mount, that holds the substrate and includes a slot into which the terminal is inserted. The bracket is detachably attached to the body, and the terminal applies pressure to the substrate and contacts the substrate by mounting the bracket to the body.

Other objects and further features of the present invention will be apparent from the following detailed description when read in conjunction with the accompanying drawings.

DESCRIPTION OF EMBODIMENTS

Figure 1:
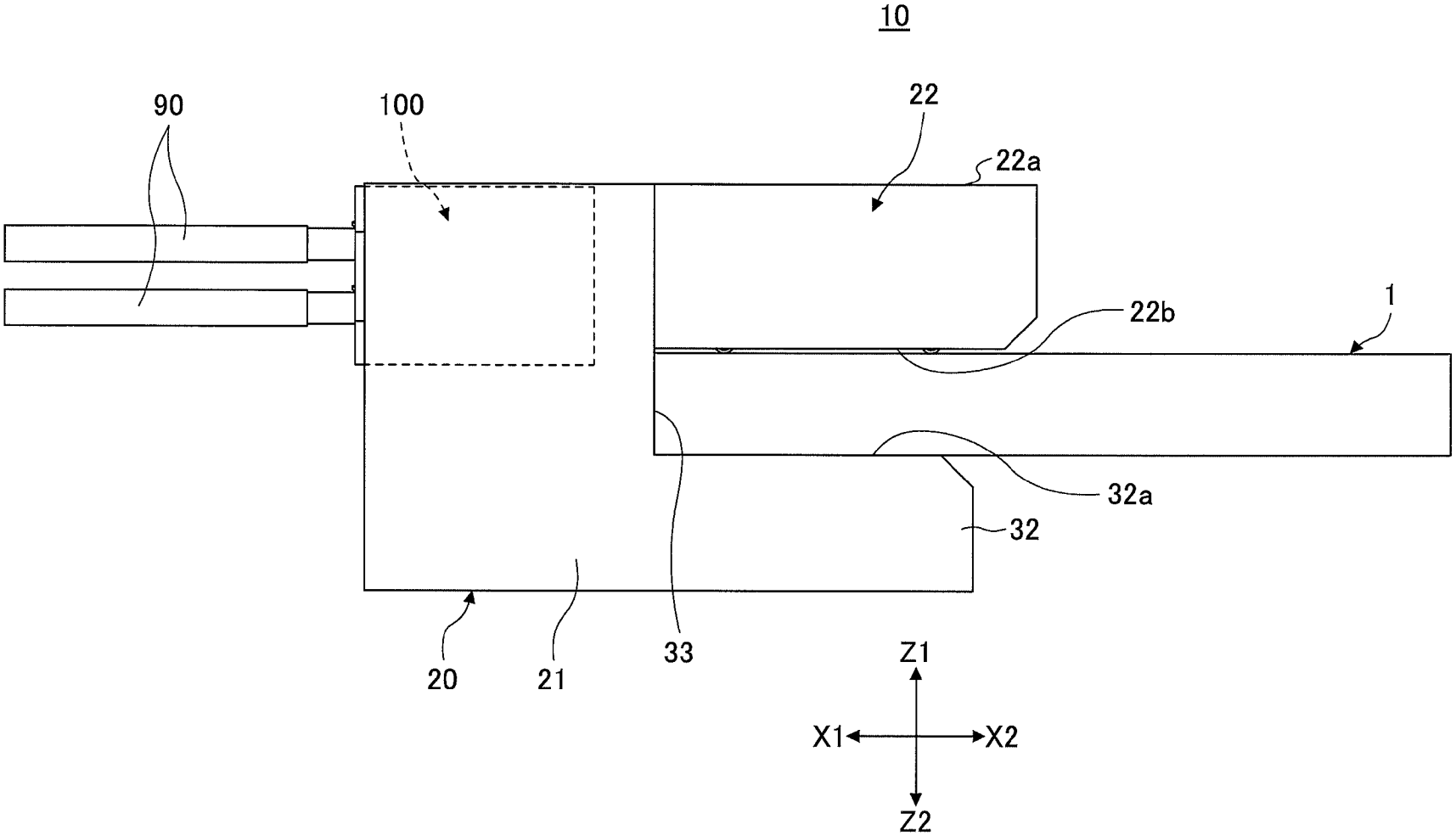
FIG. 1 is a side view of a jack connector according to an embodiment of the present invention.

In the following, embodiments of the present invention are described with reference to the accompanying drawings. Like components are denoted with like reference numerals throughout the following description and drawings.

Figure 2:
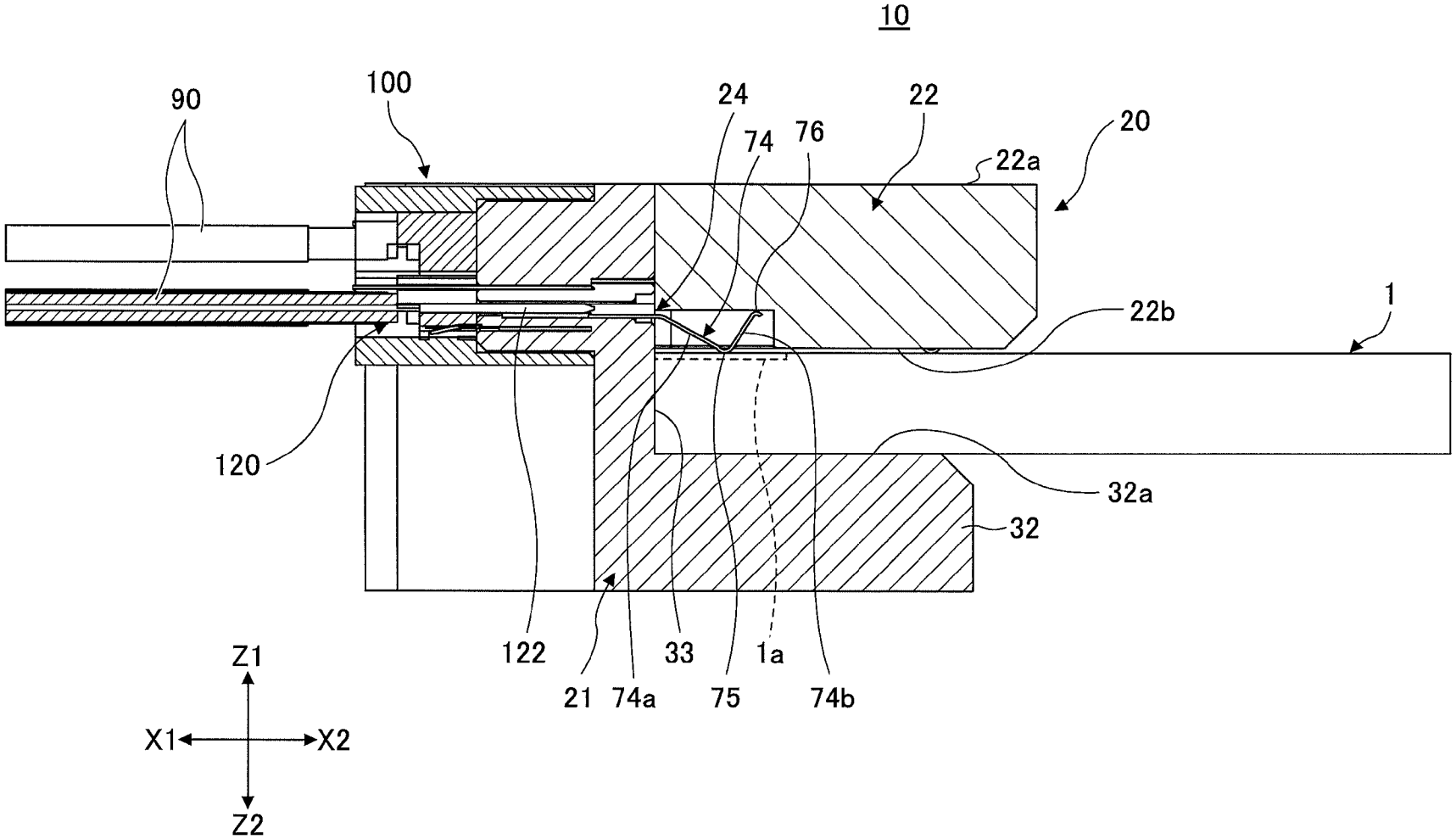
FIG. 2 is a cross-sectional view of the jack connector.

FIGS. 1 and 2 illustrate a connector 10 according to an embodiment of the present invention. FIG. 1 is a side view of the connector 10. FIG. 2 is a cross-sectional view of the connector 10.

The connector 10 is used to connect the coaxial cable 90 and a substrate 1. The connector 10 includes a jack connector 20 and a plug connector 100.

The jack connector 20 is a connector that is attached to the substrate 1. The plug connector 100 is a connector to which the coaxial cable 90 is connected. The substrate 1 and the coaxial cable 90 are electrically connected by engaging the jack connector 20 to the plug connector 100.

Figure 3:
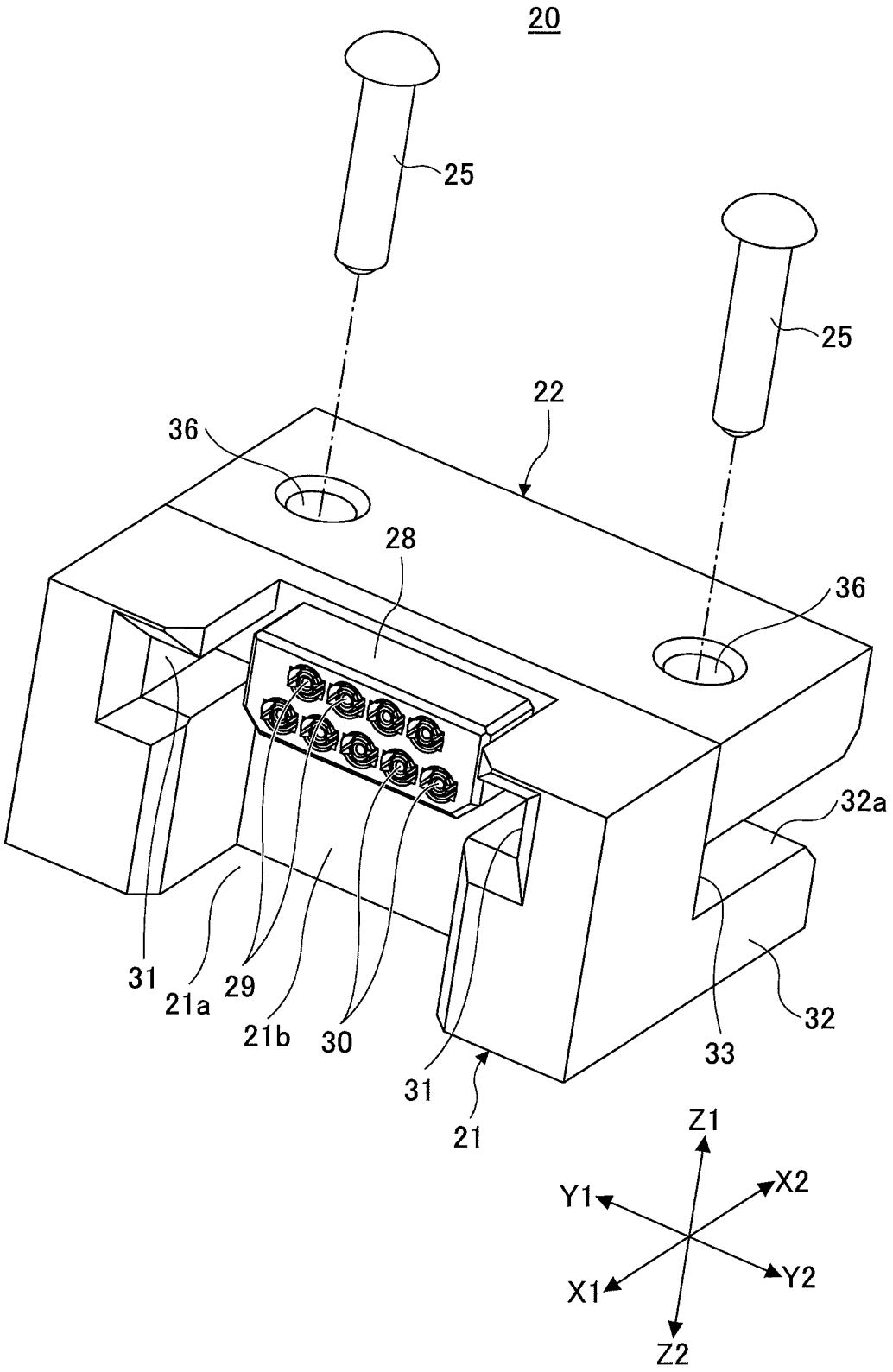
FIG. 3 is a perspective view illustrating the jack connector from which mounting screws are detached.
Figure 4:
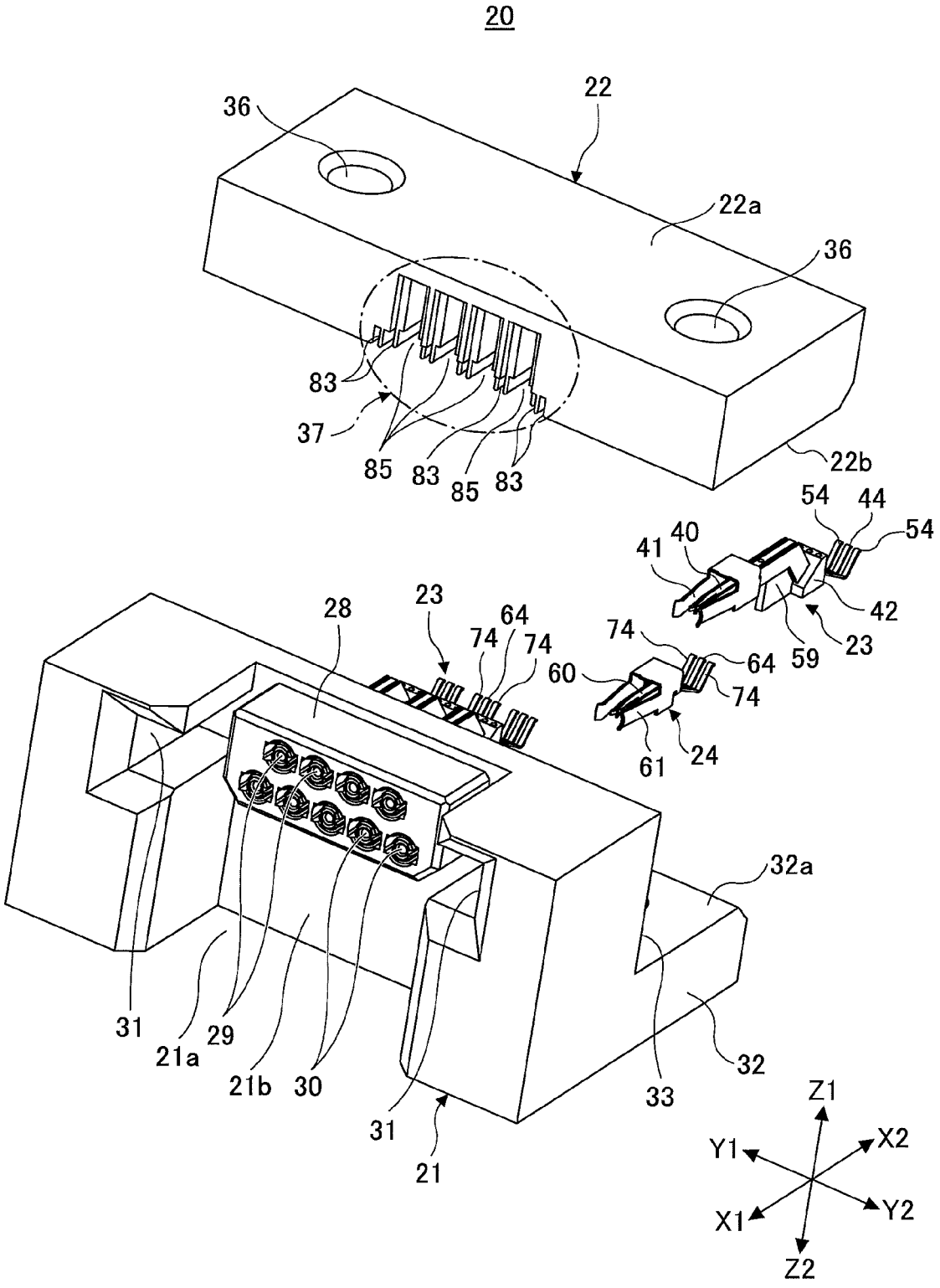
FIG. 4 is an exploded perspective view illustrating the jack connector.

FIGS. 3 and 4 illustrate the jack connector 20. FIG. 3 is a perspective view of the jack connector 20 in which the screws 25 have been removed. FIG. 4 is an exploded perspective view of the jack connector 20.

The jack connector 20 includes a jack body 21, a bracket 22, an upper contact 23, and a lower contact 24.

In the following description, the side on which the jack connector 20 engages the plug connector 100 (X1 direction) is referred to as the front side whereas its opposite side (X2 direction) is referred to as the rear side. The direction in which the bracket 22 is detachably attached to the jack connector body 21 (Z1 and Z2 direction) is referred to as the upward/downward direction. The direction that is perpendicular to both the front/rear direction and the upward/downward direction is referred to as the width direction (Y1 and Y2 direction).

The jack body 21 engaging the plug connector 100 retains the upper contact 23 and the lower contact 24. The jack body 21 includes a jack 28 and a substrate mount 32. The jack body 21 is molded from resin, so that the jack 28 and the substrate mount 32 form an integrated body.

The jack 28 is formed on a front surface of the jack body 21. A recess 21*a* is formed in the front surface of the jack body 21. The jack 28 projects in the front direction from an upright surface 21*b* at the depth of the recess 21*a*.

Guide grooves 31 are formed on both sides of the jack 28. Guide rails 115 formed in the plug connector 100 fit into the guide grooves 31 when the plug connector 100 engages the jack connector 20. The guide rails 115 and the guide grooves 31 define the positions of the jack connector 20 and the plug connector 100 engaging each other.

The substrate mount 32 is formed on the rear surface of the jack body 21 and extends in the rear direction. A mounting surface 32*a* for mounting the substrate 1 and the bracket 22 thereon is formed on an upper part of the substrate mount 32. The substrate mount 32 is set to have a height corresponding to the thickness of the substrate 1 and the thickness of the bracket 22. The jack body 21 has an L-shape when viewed from its side.

The upper contact 23 and the lower contact 24 are mounted to the jack 28.

An upper hole 29 and a lower hole 30 are formed in the jack 28. The upper hole 29 and the lower hole 30 penetrate the jack body 21. The jack 28 has four upper holes 28 arranged on its upper part in the width direction and five lower holes 30 arranged below the upper holes 28 in the width direction.

Figure 6:
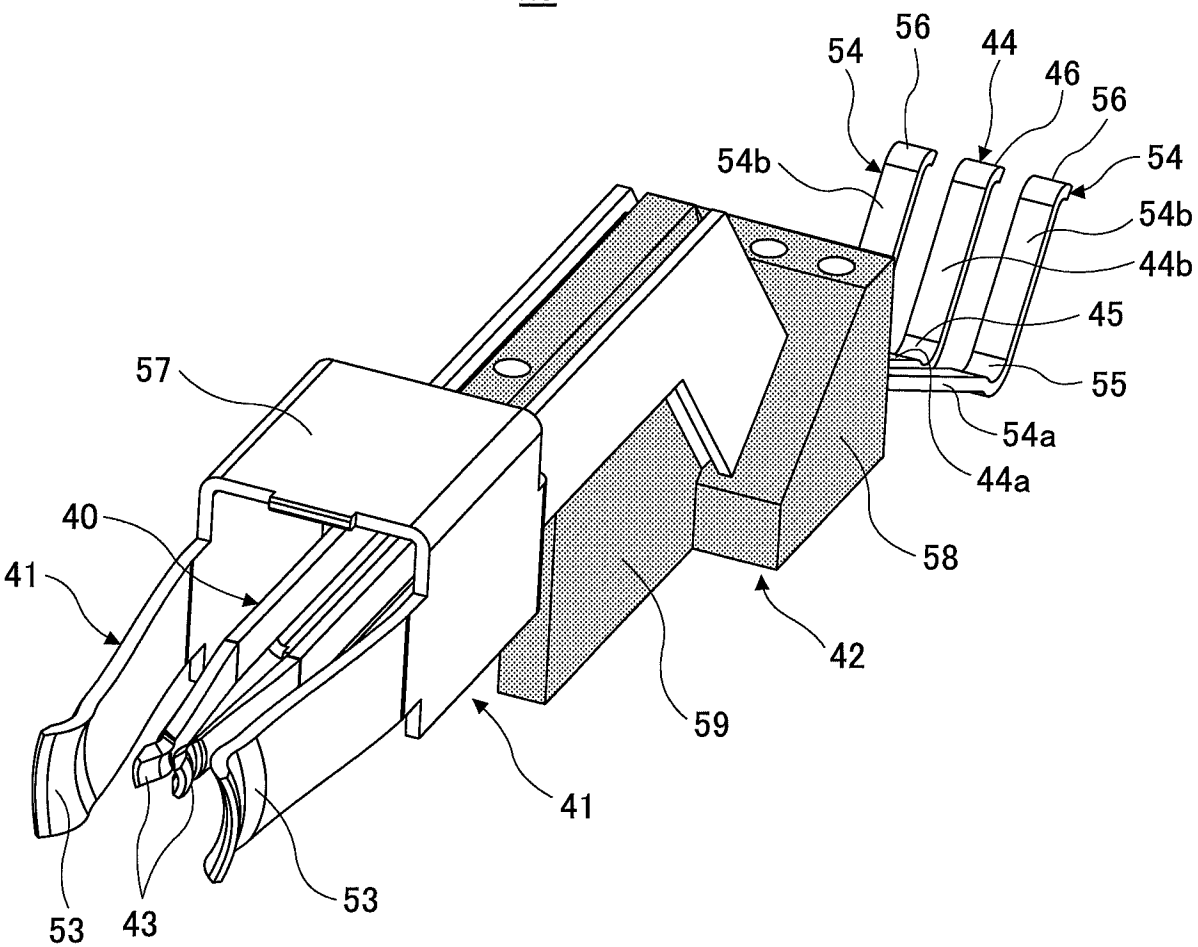
FIG. 6 is a perspective view illustrating an upper contact according to the embodiment.

The upper contact 23 is mounted to the upper hole 29. The upper contact 23 includes a signal contact 40, a ground contact 41, and a mold part 42 as illustrated in FIG. 6.

The signal contact 40 is formed from a conductive and resilient metal. The signal contact 40 includes a signal contact point 43 and a signal terminal 44.

The signal contact point 43 is formed at the front of the signal contact 40. The signal contact point 43 connects with a signal contact 122 of the plug connector 100 when the plug connector 100 is engaged with the jack connector 20.

The signal contact point 43 is formed by separating a tip of the signal contact 40 into two ends that face each other. The signal contact 122 is held between the signal contact points 43.

The signal terminal 44 is formed at the rear of the signal contact 40. The signal terminal 44 includes a beam 44*a* that extends diagonally downward in the rear direction and an arm 44*b* that extends diagonally upward from an end of the beam 44*a* in the rear direction. The signal terminal 44 has a V-shape when viewed from the side.

A lower bend at which the beam 44*a* and the arm 44*b* join is a contact point 55 that exerts pressure to and contacts the connection terminal 1*a* when the jack connector 20 is mounted to the substrate 1. A rear end of the arm 44*b* is bent to form a target pressure part 46 to which pressure is exerted.

The ground contact 41 is formed from a conductive and resilient metal. The ground contact 41 includes a ground contact point 53, a ground terminal 54, and a coupling part 57. A pair of ground contacts 41 is arranged in a manner that the signal contact 40 is provided therebetween. The pair of ground contacts 41 are coupled to each other by the coupling part 57. The pair of ground contacts 41 and the coupling part 57 are formed as an integrated body by pressing a sheet material.

A pair of ground contact points 53 is formed at the front of the ground contact 41. Each ground contact 41 has the ground contact points 53 facing each other. A ground contact 124 of the plug connector 100 is inserted between the ground contact points 53 when the plug connector 100 is engaged with the jack connector 20, and the ground contact points 53 and the ground contact 124 are connected.

The ground terminal 54 is formed at the rear of the ground contact 41. The ground terminal 54 includes a beam 54*a* that extends diagonally downward in the rear direction and an arm 54*b* that extends diagonally upward from an end of the beam 54*a* in the rear direction.

The ground terminal 54 is formed in the same shape as that of the signal terminal 44 of the signal contact 40. Accordingly, the ground terminal 54 also has a V-shape. A contact point 55 is formed at a lower bend at which the beam 54*a* and the arm 54*b* join. A rear end part of the arm 54*b* is bent to form a target-pressure part 56.

The mold part 42 formed of an insulating resin is provided between the signal contact point 43 and the signal terminal 44, and between the ground contact point 53 and the ground terminal 54.

The mold part 42 includes a mold body 58 and a wall 59. The signal contact 40 and the ground contact 41 are insert-molded to the mold body 58, and the signal contact 40 and the ground contact 41 form an integrated body with the mold part 42. The wall 59 extends from the mold body 58 in the front direction.

Figure 7:
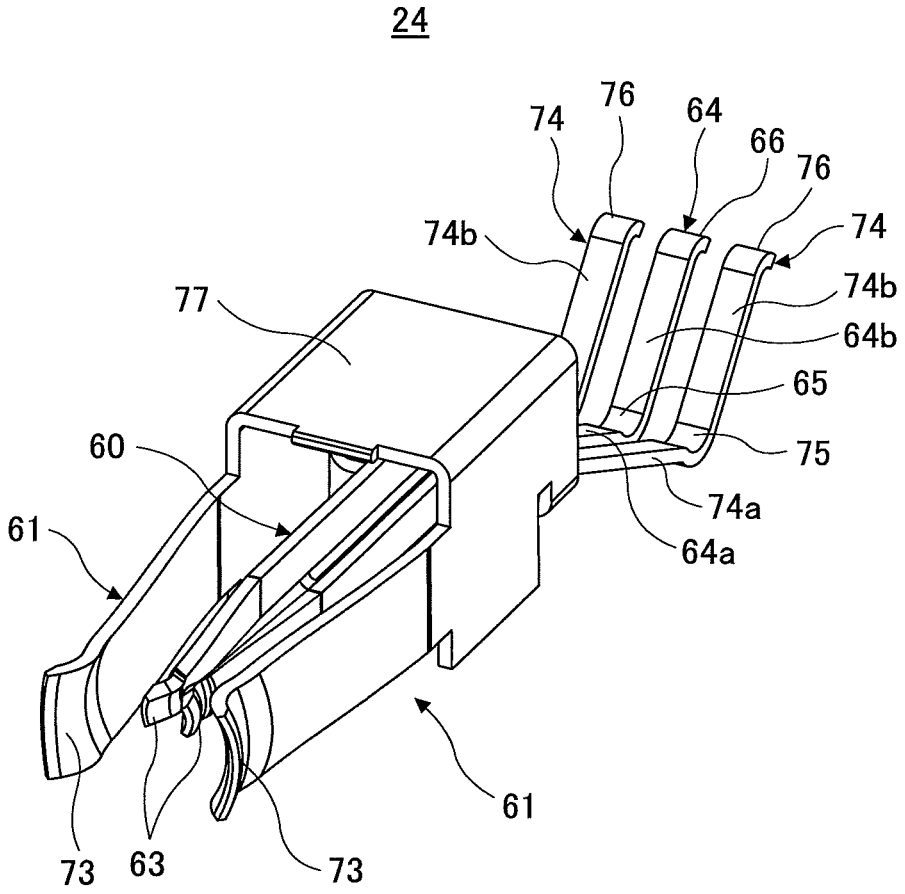
FIG. 7 is a perspective view illustrating a lower contact according to the embodiment.

The lower contact 24 is mounted to the lower hole 30 of the jack 28. The lower contact 24 includes a signal contact 60 and a ground contact 61 as illustrated in FIG. 7. The lower contact 24 has substantially the same configuration as the upper contact 23 except that the lower contact 24 is longer than the upper contact 23 and that the lower contact 24 does not include the mold part 42. In the description of the lower contact 24, like components and parts as those of the upper contact 23 are not described in further detail.

The signal contact 60 is formed of a conductive and resilient metal. The signal contact 60 includes a signal contact point 63 and a signal terminal 64.

The signal contact point 63 is formed at the front of the signal contact 60. The signal contact point 63 connects with the signal contact 122 when the plug connector 100 is engaged with the jack connector 20.

The signal terminal 64 is formed at the rear of the signal contact 60. The signal terminal 64 includes a beam 64*a* that extends diagonally downward in the rear direction and an arm 64*b* that extends diagonally upward from an end of the beam 64*a* in the rear direction. The signal terminal 64 has a V-shape. A lower bend at which the beam 64*a* and the arm 64*b* join is a contact point 65 that exerts pressure to and contacts the connection terminal 1*a*. A rear end part of the arm 64*b* is bent to form a target-pressure part 66.

The ground contact 61 is formed of a conductive and resilient metal. The ground contact 61 includes a ground contact point 73, a ground terminal 74, and a coupling part 77. A pair of ground contacts 61 is arranged in a manner that the signal contact 60 is provided therebetween. The pair of ground contacts 61 is coupled to each other by the coupling part 77.

A pair of ground contact points 73 is formed at the front of the ground contact 61. The ground contact 61 has the ground contact points 73 facing each other. The ground contact 124 is held between the ground contact points 73 when the plug connector 100 is engaged with the jack connector 20. By having the ground contact 124 held between the pair of ground contact points 73, the ground contact points 73 and the ground contact 124 are connected.

The ground terminal 74 is formed at the rear of each ground contact 61. The ground terminal 74 includes a beam 74*a* extending diagonally downward in the rear direction and an arm 74*b* extending diagonally upward from an end of the beam 74*a*.

The ground terminal 74 is formed with the same shape as the shape of the signal terminal 64. Accordingly, the ground terminal 74 also has a V-shape. A contact point 75 is formed at a lower bend at which the beam 74*a* and the arm 74*b* join. A rear end part of the arm 74*b* is bent to form a target-pressure part 76.

The bracket 22 includes an insertion hole 36 and a fitting part 37.

The screws 25 are inserted into the insertion holes 36 when the bracket 22 is mounted to the jack body 21. The insertion hole 36 is formed in a position corresponding to the position of the screw hole formed in the substrate mount 32. Insertion holes are also formed in the substrate 1 in areas corresponding to the insertion holes. Accordingly, the bracket 22 can be attached to the substrate 1 by inserting the screws 25 in insertion holes and fastening the screws 25 to the screw holes of the substrate mount 32.

Figure 5A:
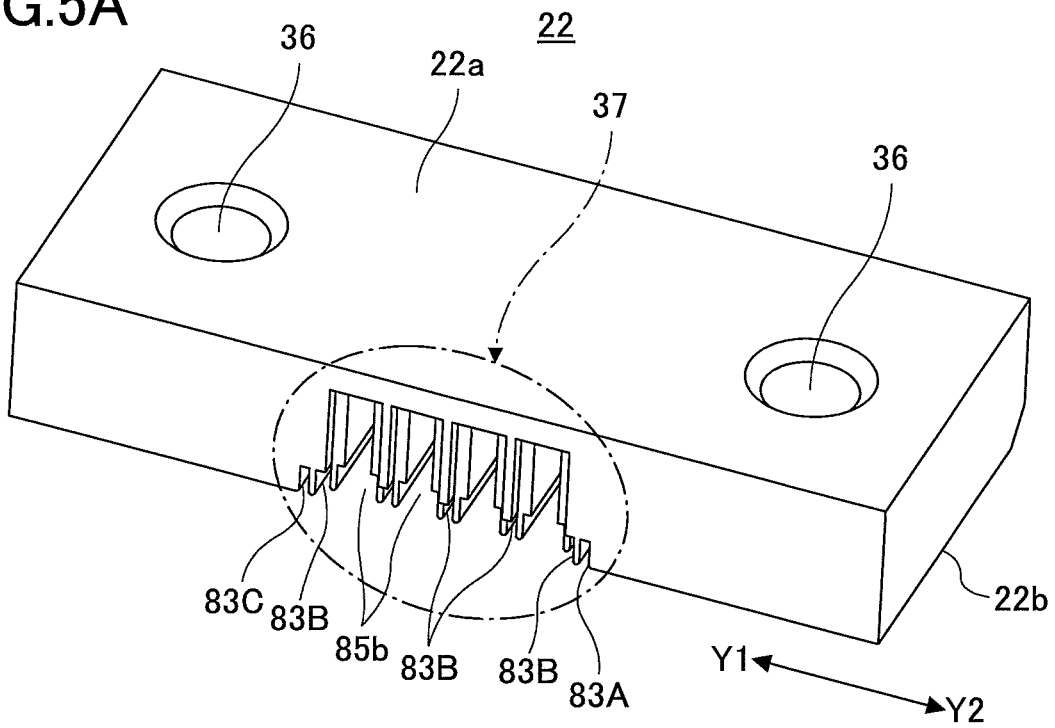
FIG. 5A is a front perspective view illustrating a bracket according to the embodiment.
Figure 5B:
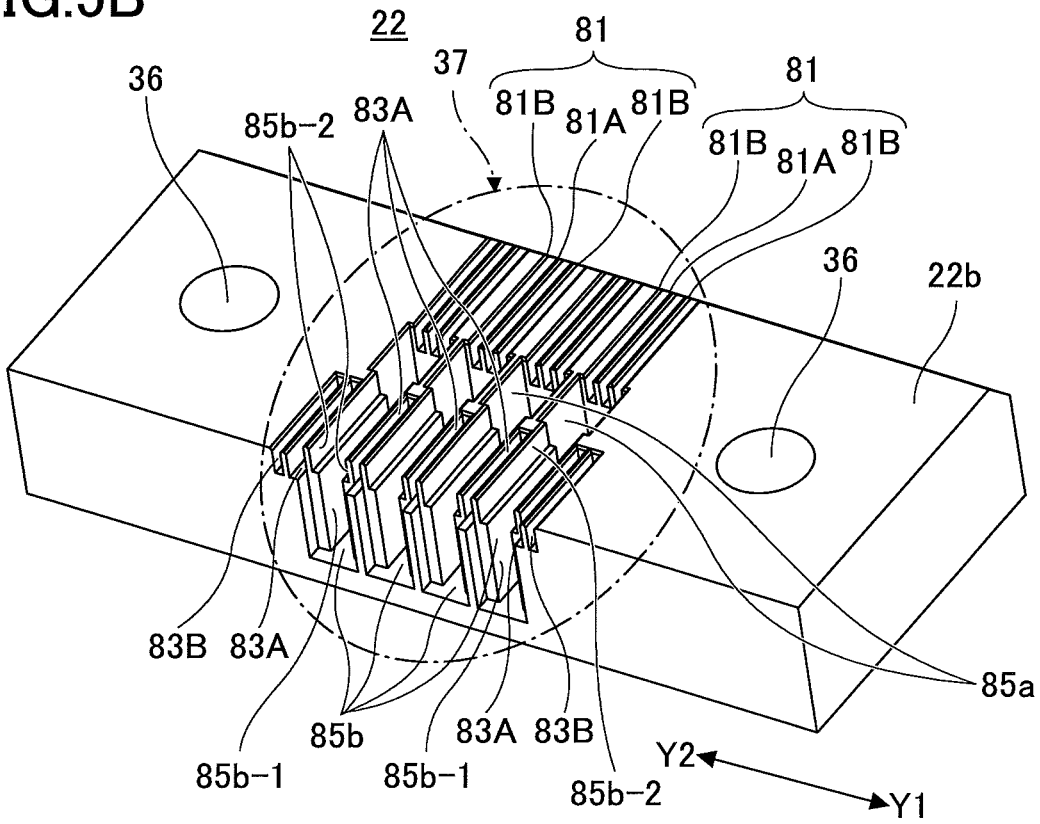
FIG. 5B is a rear perspective view illustrating the bracket.

The fitting part 37 is formed at a rear surface 22*b* of the bracket 22. The fitting part 37 includes an upper groove 81, a lower groove 83, and an insertion groove 85 as illustrated in FIG. 5B.

In assembling the jack connector 20, the upper contact 23 and the lower contact 24 are mounted to the jack 28 beforehand. The signal terminal 44, the ground terminal 54, and the mold part 42 of the upper contact 23 project from a rear surface 33 of the jack body 21 when the upper contact 23 and the lower contact 24 are mounted to the jack 28. The signal terminal 64 and the ground terminal 74 of the lower contact 24 also project from the rear surface 33 of the jack body 21.

The signal terminal 44 and the ground terminal 54 are inserted into the upper groove 81 when the bracket 22 is mounted to the jack body 21.

The upper groove 81 includes an upper center groove 81A positioned at the center of the upper groove 81 and a pair of upper side groove 81B formed on both sides of the upper center groove 81A. The signal terminal 44 of the upper contact 23 is inserted into the upper center groove 81A. The ground terminals 54 of the upper contact 23 are inserted into the upper side grooves 81B. The positions of the signal terminal 44 and the ground terminal 54 are defined by the upper groove 81, so that the signal terminal 44 and the ground terminal 54 are prevented from interfering with each other.

The insertion groove 85 includes a body insertion part 85*a* into which the mold body 58 is inserted and a wall insertion part 85*b* into which the wall 59 is inserted.

The signal terminal 64 and the ground terminal 74 of the lower contact 24 are inserted into the lower groove 83.

The lower groove 83 includes a lower center groove 83A positioned at the center of the lower groove 83 and a pair of lower side grooves 83B formed on both sides of the lower center groove 83A. The signal terminal 64 of the lower contact 24 is inserted into the lower center groove 83A. The ground terminals 74 of the lower contact 24 are inserted into the lower side grooves 83B. The positions of the signal terminal 64 and the ground terminal 74 are defined by the lower groove 83, so that the signal terminal 64 and the ground terminal 74 are prevented from interfering with each other.

Figure 9:
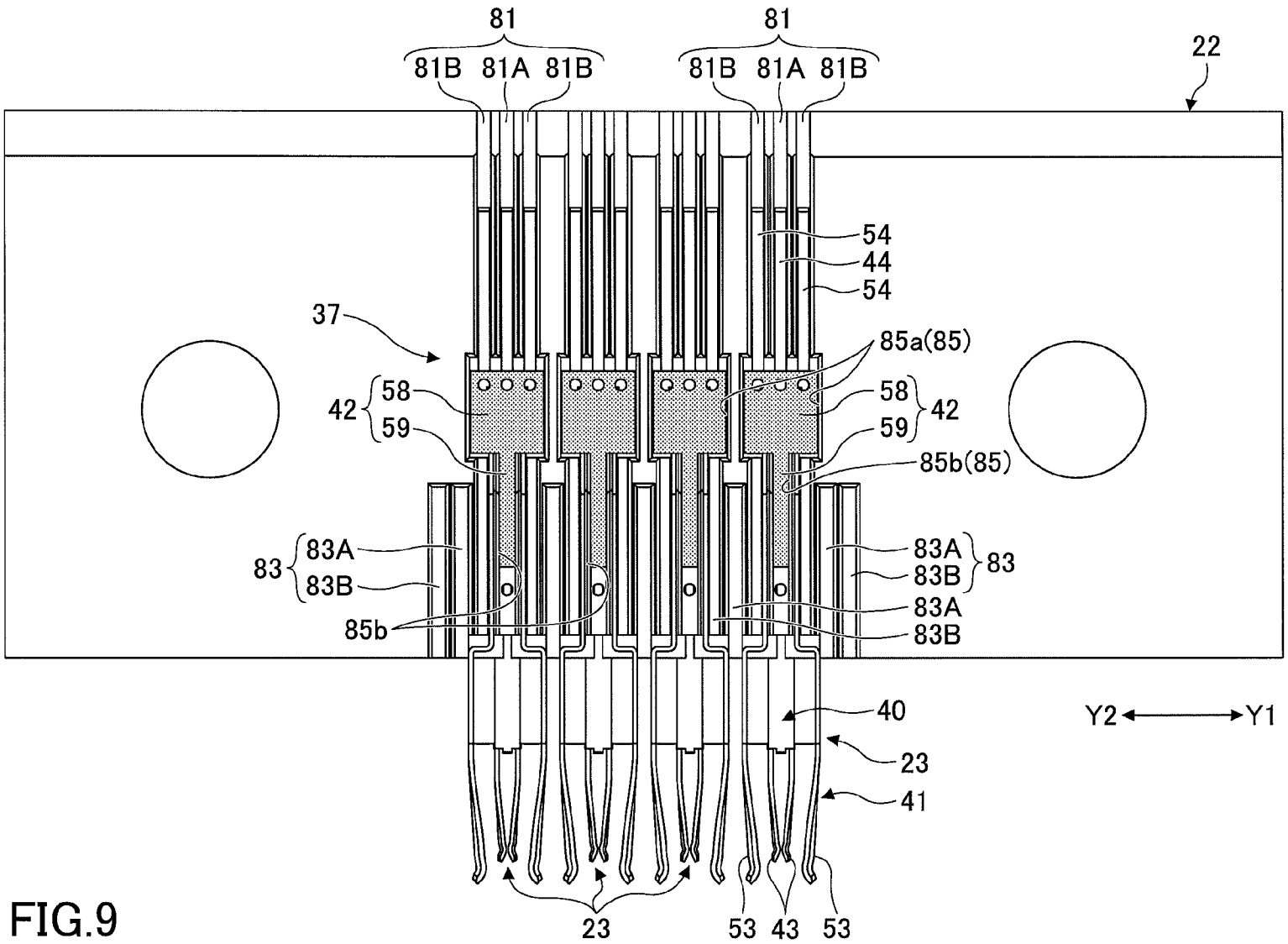
FIG. 9 is a bottom view illustrating upper contacts engaging to the bracket.

As illustrated in FIG. 9, the lower side grooves 83B partly overlap with the area at which the wall insertion part 85*b* is formed.

In this embodiment, five lower grooves 83 are formed in correspondence with the number of the lower contacts 24. Each lower groove 83 includes the lower center groove 83A. The rightmost lower groove 83 provided at a right end (i.e., end toward the direction Y1) in FIG. 5B is formed having the lower center groove 83A and the lower side groove 83B on the right side of the lower center groove 83A. However, the lower side groove 83B is not formed on the left side of the lower center groove 83A because the wall insertion part 85*b* is formed on the left side of the lower center groove 83A.

The leftmost lower groove 83 provided at a left end (i.e., end toward the direction Y2) in FIG. 5B is formed having the lower center groove 83A and the lower side groove 83B on the left side of the lower center groove 83A. However, the lower side groove 83B is not formed on the right side of the lower center groove 83A because the wall insertion part 85*b* is formed on the right side of the lower center groove 83A.

Three lower grooves 83 formed at the center in FIG. 5B only have the lower center groove 83A, respectively. The lower side grooves 83B are not formed on both sides of the lower center groove 83A because the wall insertion parts 85*b* are formed on both sides of the lower center groove 83A.

Next, the insertion of the upper contacts 23 and the lower contacts 24 into upper grooves 81 and the lower grooves 83 will be described.

When mounting the bracket 22 to the jack body 21, the upper contact 23 and the lower contact 24 are inserted into the fitting parts 37, respectively.

Figure 8:
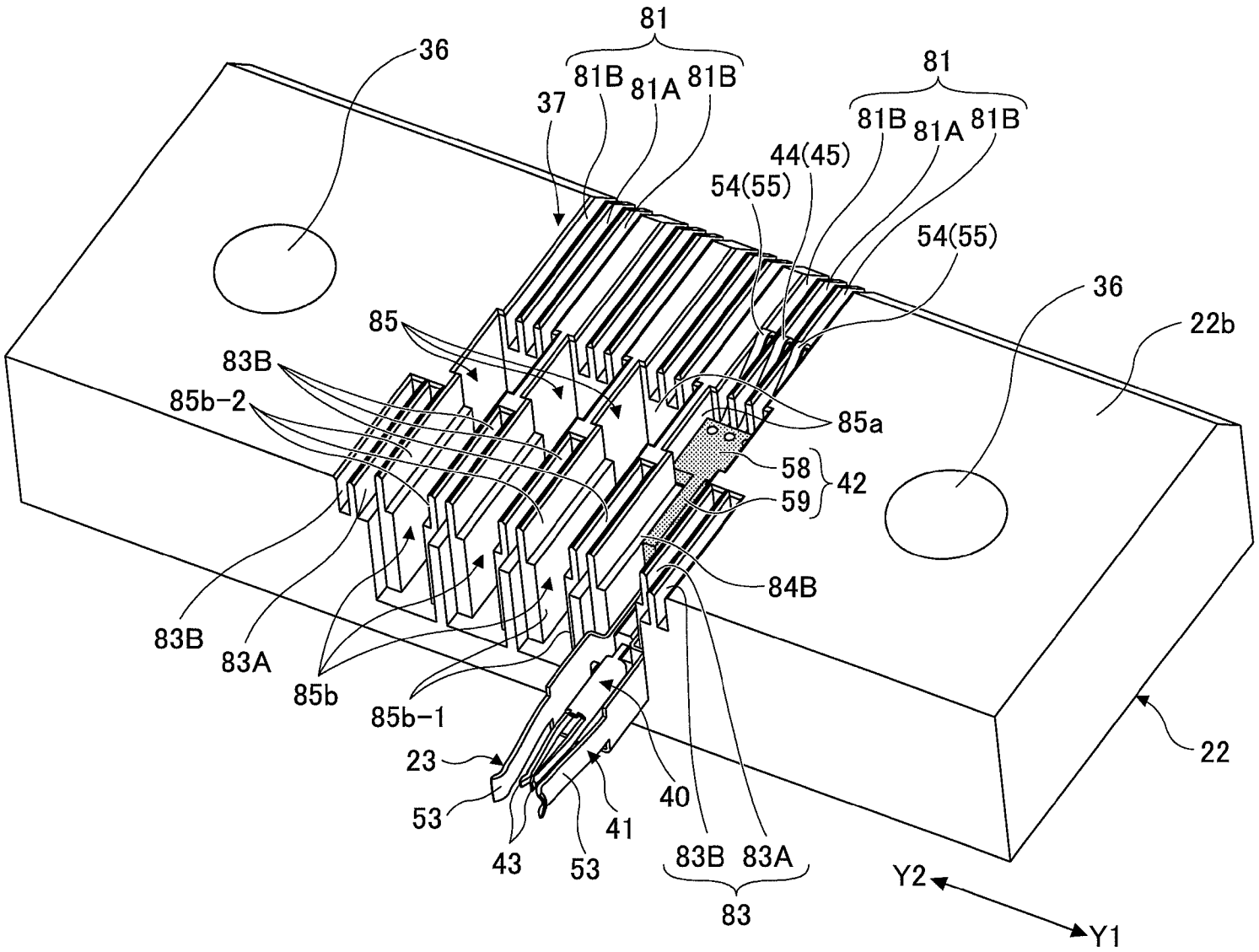
FIG. 8 is a perspective view illustrating one upper contact engaging to the bracket.

FIG. 8 illustrates a state where one upper contact 23 is inserted into the upper insertion groove 85. FIG. 9 illustrates a state where all of the upper contacts 23 are inserted into insertion grooves 85. The jack body 21 is omitted from FIGS. 8 and 9.

When upper contact 23 is inserted into the insertion groove 85, the signal terminal 44 is inserted into the upper center groove 81A, and the ground terminal 54 is inserted into each upper side groove 81 on both sides of the upper center groove 81A.

The mold body 58 is inserted into the body insertion part 85*a*, and the wall part 59 is inserted into the wall insertion part 85*b*. When the wall part 59 is inserted into the wall insertion part 85*b*, a part of the signal contact 40 and the ground contact 41 extending along the wall part 59 are also inserted into the wall insertion part 85*b*.

The width of the wall part 59 is set to be shorter than the width of an upper part of the wall insertion part 85*b*. The wall part 59 inserted into the wall insertion part 85*b* is positioned at a center of the wall insertion part 85*b*.

When the wall part 59 is inserted into the wall insertion part 85*b*, a space is formed between both sides of the wall part 59 and both sides of the inner wall of the wall insertion part 85*b*. The width of the space is set to be equal to the width of the lower side groove 83B.

After the upper contact 23 is inserted into the fitting part 37, the lower contact 24 is inserted into the fitting part 37 by further moving the bracket 22 toward the substrate mount 32.

The wall part 59 being inserted into the wall insertion part 85*b* when the upper contact 23 is inserted into the fitting part 37, and the lower side groove 83B corresponding to the ground terminal 74 is formed.

In FIG. 9, the lower side groove 83B is not formed on the left side of the lower groove 83 in the rightmost end of the fitting part 37. However, a space functions as the lower side groove is formed between the wall part 59 and an inner wall of a narrow part 85*b*-2 formed at an upper part of the wall insertion part 85*b*, by inserting the wall part 59 between the wide parts 85*b*-1 formed at the wall insertion part 85*b*.

Because the lower groove 83 corresponding to the signal terminal 64 and the ground terminal 74 of the lower contact 25 provided at the lower rightmost end of the jack connector 20 is so formed, the lower contact 24 at the lower rightmost end can be inserted into the bracket 22.

Further, in FIG. 9, the lower side groove 83B is not formed in the lower groove 83 on the right side in the leftmost end of the fitting part 37. However, the lower side groove 83B is formed between the wall part 59 and the wall insertion part 85*b* by inserting the wall part 59 into the wall insertion part 85*b*.

Because the lower groove 83 corresponds to the signal terminal 64 and the ground terminal 74 provided at the lower leftmost end of the jack connector 20 is formed, the lower contact 24 positioned at the lower leftmost end of the jack connector 20 can be inserted into the bracket 22.

Only the lower center groove 83A is formed in each of the three lower grooves 83 provided at the center portion of the fitting part 37. Because the wall insertion part 85*b* is formed on both sides of the lower center groove 83A, the lower side groove 83B is not formed on the bracket 22. However, the lower side groove 83B is formed on both sides of the lower center groove 83A by inserting the wall part 59 into the wall insertion part 85*b*.

Accordingly, because the lower groove 83 corresponds to the signal terminal 64 and the ground terminal 74 of each of three lower contacts 24 provided at the center portion is formed, the lower contact 24 positioned at the center portion can be inserted into the bracket 22.

With the above-described embodiment, the lower side groove 83 is formed by inserting the wall part 59 into the wall insertion part 85*b*. Accordingly, the upper groove 81 and the lower groove 83 are positioned closer to each other and the upper contact 23 and the lower contact 24 are formed close to each other, compared to a configuration in which the lower side groove 83B is formed directly in the bracket 22. Hence, high densification of the arrangement of contacts and size-reduction of the jack connector 20 can be achieved.

Each contact point 45, 55, 65, and 75 of each terminal 44, 54, 65, and 74 projects from the rear surface 22*b* of the bracket 22 when the upper and lower contacts 23, 24 are inserted into the upper and lower grooves 81, 83, respectively.

Figure 10:
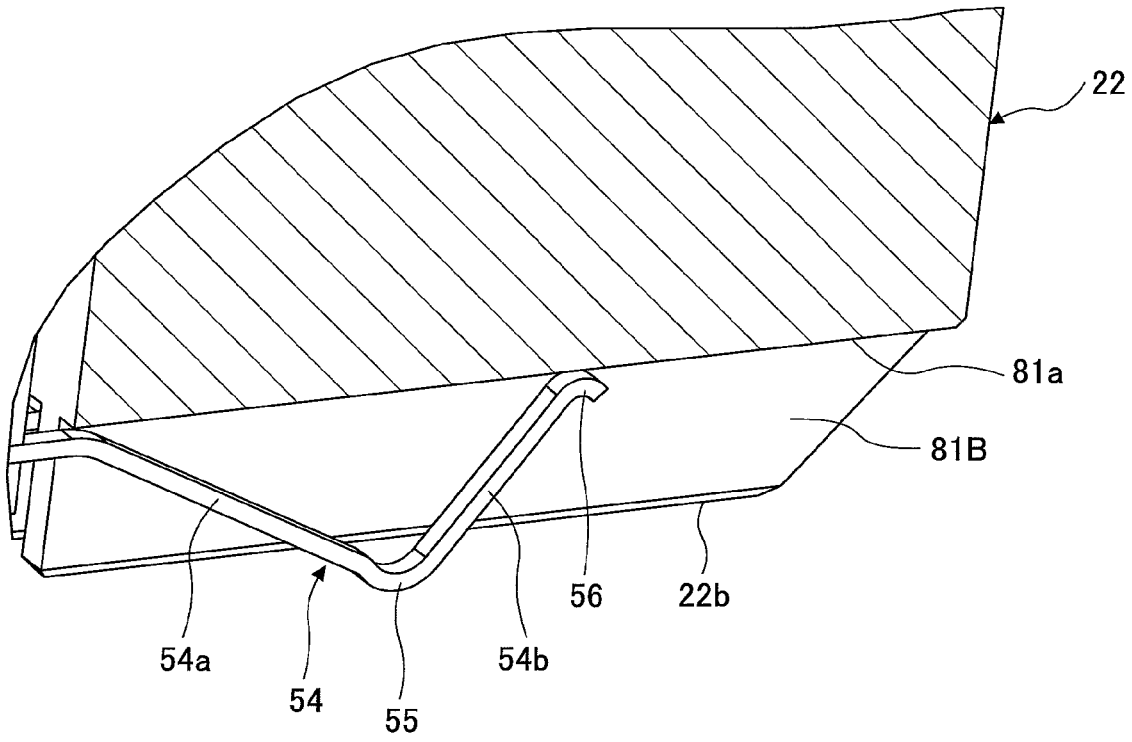
FIG. 10 is an enlarged perspective view illustrating a terminal according to the embodiment.

FIG. 10 illustrates a state where the contact point 55 projects from the rear surface 22*b* of the bracket 22. The terminals 44, 54, 64, 74 have the same shape and are inserted into the bracket 22 in the same manner. Although FIG. 10 only illustrates the contact point 55, the same applies to the other contact points 45, 65, and 75.

When the ground terminal 54 is inserted into the upper side groove 81B as illustrated in FIG. 10, the contact point 55 projects from the rear surface 22*b* of the bracket 22, and the target-pressure part 56 contacts a bottom surface 81*a* of an upper groove 81*b*.

By placing the bracket 22 on the substrate 1 mounted to the substrate mount 32 and fastening the screws 25, each target-pressure part 56 is pressed by corresponding bottom surface 81*a*, and each contact point 55 projecting from the rear surface 22*b* exerts pressure to and contacts the connection terminal 1*a*. Note that FIG. 2 illustrates a state where the ground terminal 74 of the lower contact 24 exerts pressure to and contacts the connection terminal 1*a*.

The substrate 1 and the jack connector 20 are electrically connected to each other when each of the contact points 45, 55, 65, and 75 contacts the corresponding connection terminal 1*a*. Hence, with the above-described embodiment, the contact points 45, 55, 65, and 75 can contact the connection terminal 1*a* without soldering, and the substrate 1 and the jack connector 20 can be firmly connected.

Because the terminals 44, 54, 64, and 74 are not soldered to the connection terminal 1*a*, a connection of the jack connector 20 and the substrate 1 can be simplified. Further, the substrate 1 can be easily removed from the jack connector 20 by removing the screws 25. Therefore, the substrate 1 and the jack connector 20 can be easily repaired or inspected.

Each terminal 44, 54, 64, and 74 elastically deforms as the contact points 45, 55, 65, and 75 exert pressure to the connection terminal 1*a*. As the terminals 44, 54, 64, 74 deforms, the terminals 44, 54, 64, 74 move to enter the upper center groove 81A and the upper side groove 81B from the rear surface 22*b* of the bracket 22. However, when the contact points 45, 55, 65, 75 are released from the pressing contact with the connection terminal 1*a*, the terminals 44, 54, 64 and 74 are elastically recovered, so that the contact points 45, 55, 65, 75 project from the rear surface 22*b*. The contact points 45, 55, 65, 75 can be firmly connected to the connection terminal 1*a* even if the substrate 1 is repeatedly attached to or detached from the jack connector 20.

Next, the plug connector 100 is described.

Figure 11:
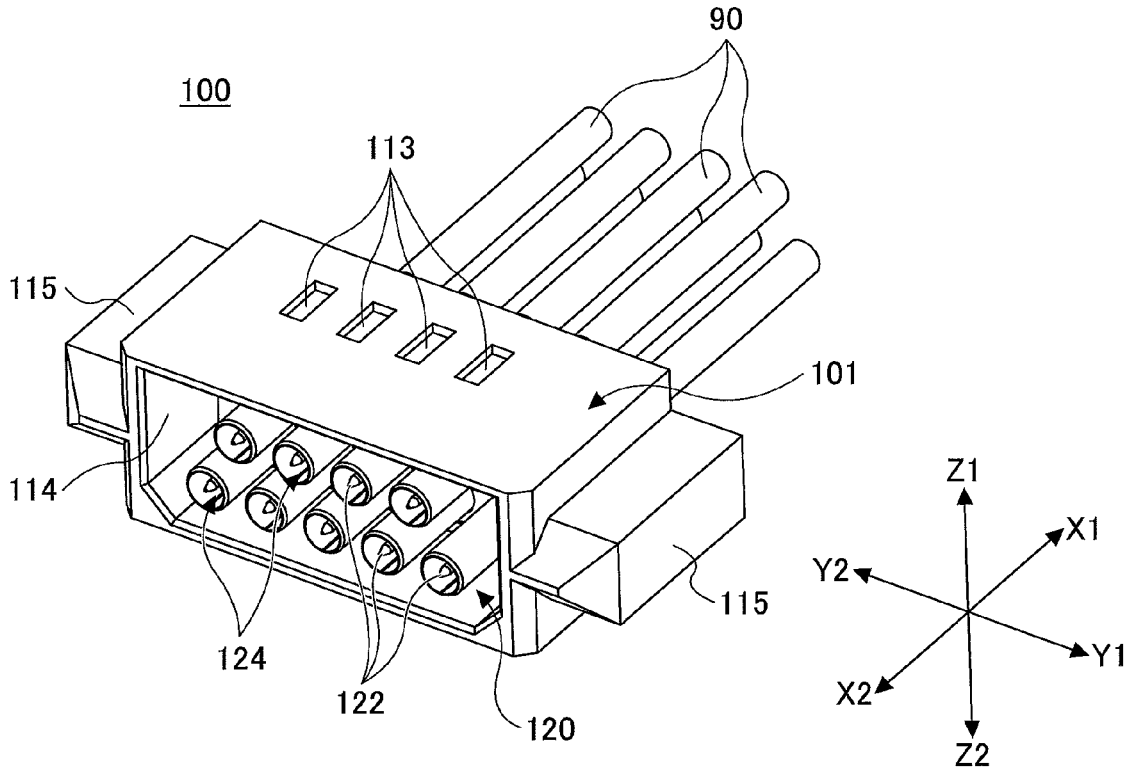
FIG. 11 is a perspective view illustrating a plug connector according to the embodiment.
Figure 12:
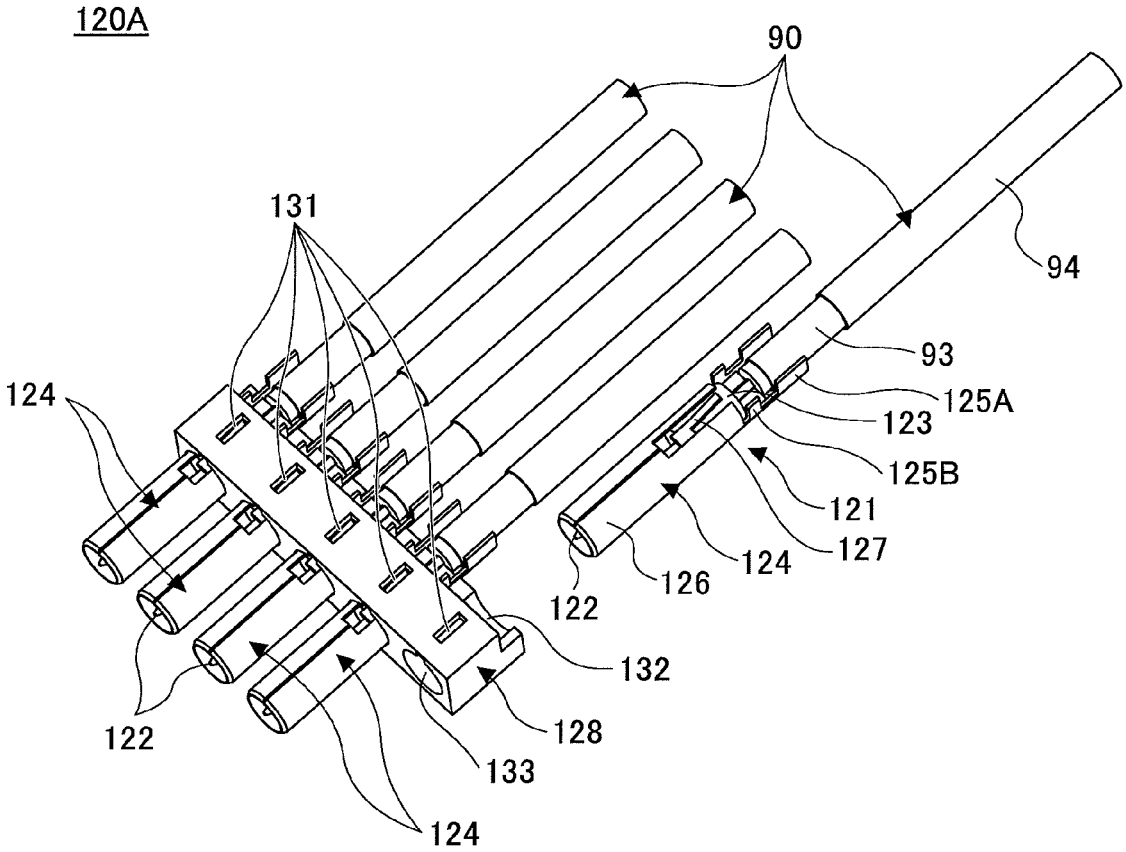
FIG. 12 is a contact module according to the embodiment.
Figure 13:
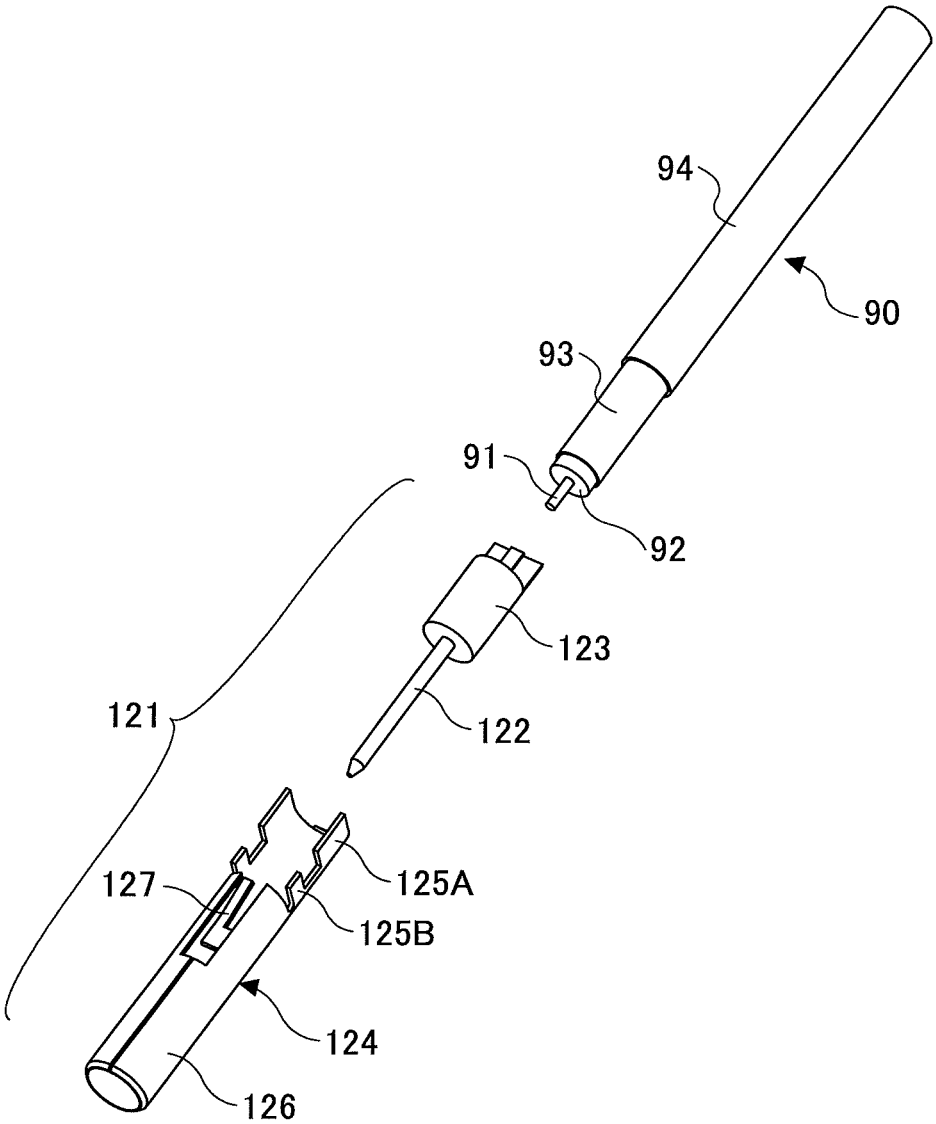
FIG. 13 is a perspective view illustrating a common ground member according to the embodiment.

FIGS. 11 to 13 are schematic diagrams of the plug connector 100. FIG. 11 is a perspective view illustrating the outside of the plug connector 100 according to the embodiment. FIG. 12 is a perspective view illustrating a contact module 120 provided in the plug connector 100. FIG. 13 is an exploded perspective view illustrating a coaxial contact 121 connected to the coaxial cable 90.

In the following description, the side on which the plug connector 100 engages the jack connector 20 (X2 direction) is referred to as the front side whereas its opposite side (X1 direction) is referred to as the rear side. The direction in which the coaxial contacts 21 overlap with each other (Z1 and Z2 direction) is referred to as the upward/downward direction. The direction that is perpendicular to both the front/rear direction and the upward/downward direction (Y1 and Y2 direction) is referred to as the width direction.

The plug connector 100 engaging the jack connector 20 includes the plug body 101 and the contact module 120.

The plug body 101 is molded with resin. The plug body 120 includes a window 113, a recess 114, and a guide rail 115. The window 113 is formed on upper and lower surfaces of the plug body 101 having a rectangular shape. The window 113 formed on the lower surface of the plug body 101 is not illustrated in the drawings. The window 113 is a hole into which a jig is inserted when removing the coaxial cable 90 from the plug connector 100.

The recess 114 is formed at the front of the plug connector 100. The jack 28 is fitted into the recess 114 when the plug connector 100 is engaged with the jack connector 20.

The guide rail 115 fitted into the guide groove 31 is provided on both sides of the recess 114.

The contact module 120 includes a coaxial contact 121 to which the coaxial cable 90 is connected and a holder 128 to which the coaxial contact 121 is mounted as illustrated in FIG. 12.

The coaxial cable 90 includes a center conductor 91 for guiding signals therethrough, a dielectric 92 for encapsulating the center conductor 91 therein, an external conductor 93 encompassing the dielectric 92 for providing ground potential, and a cover 94 for covering the external conductor 93 as illustrated in FIG. 13.

The coaxial contact 121 includes a signal contact 122, a coaxial insulator 123, and a ground contact 124 as illustrated in FIG. 13.

The signal contact 122 having a pointed tip is electrically connected to the signal contact point 43 of the upper contact 23 and the signal contact point 63 of the lower contact 24 when the jack connector 20 and the plug connector 100 engage.

The signal contact 122 is retained in the coaxial insulator 123. The coaxial insulator 123 is an insulating resin having a cylindrical shape. The signal contact 122 may be insert-molded to the coaxial insulator 123.

The signal contact 122 not only extends toward the front of the coaxial insulator 123 but also projects from the coaxial insulator 123 in the rear direction. The part of the signal contact 122 projecting from the coaxial insulator 123 is electrically connected to the center conductor 91 of the coaxial cable 90, and the coaxial cable 90 and the signal contact 122 are electrically connected to each other.

The ground contact 124 having a cylindrical shape is electrically connected to the ground contact point 53 of the upper contact 23 and the ground contact point 73 of the lower contact 24 when the plug connector 100 is engaged with the jack connector 20.

The ground contact 124 includes fixing parts 125A, 125B, a contact body 126, and a protrusion 127.

The fixing parts 125A, 125B are provided at the rear of the ground contact 124. The fixing part 125A is caulked to the external conductor 93. The fixing part 125B is caulked to the coaxial insulator 123.

The ground contact 124 is attached to the coaxial cable 90 and electrically connected to the external conductor 93 by caulking the fixing part 125A to the external conductor 93. Thereby, the ground contact 124 becomes ground potential. The fixing part 125A has a larger dimension than the fixing part 125B for ensuring the electric connection between the fixing part 125A and the external conductor 93.

The coaxial insulator 123 is fixed to the ground contact 124 by caulking the fixing part 125B to the coaxial insulator 123. Because the signal contact 122 is retained in the coaxial insulator 123, the signal contact 122 is fixed to the center of the ground contact 124 by fixing the coaxial insulator 123 to the ground contact 124.

The contact body 126 having a cylindrical shape is formed at the front of the ground contact 124. The contact body 126 connects with the ground contact point 53 when the plug connector 100 is engaged with the jack connector 20.

The protrusion 127 is integrally formed with the contact body 126, and projects outward from the outer surface of the contact body 126. The protrusion 127 is fitted to the holder 128 by being fitted into a window 131 when the coaxial contact 121 is inserted into the holder 128.

The holder 128 having a rectangular shape and is formed of an insulating resin retains the coaxial contact 121 therein. The holder 128 further includes a guide 132 and an insertion hole 133.

The window 131 formed on the upper surface of the holder 128 is in communication with the insertion hole 133. The insertion hole 133 penetrates the holder 128. The guide 132 is formed on rear surface of the holder 128 below the insertion hole 133.

The holder 128 is mounted to the plug body 101 after the coaxial contact 121 is mounted to the holder 128. Thereby, the coaxial contact 121 is mounted to the plug body 101.

The contact module 120A illustrated in FIG. 12 is positioned at a lower part of the plug body 101. The contact module 120 is configured to have five coaxial contacts 121 mounted to the holder 128. Although not illustrated in the drawings, a contact module provided at the upper part of the plug body 101 is configured to have four coaxial contacts 121 mounted to the holder 128.

The plug connector 100 illustrated in FIG. 11 is fabricated by mounting the contact modules 120 to the upper and lower parts of the plug body 101.

Next, a process of mounting the coaxial contact 121 to the holder 128 is described.

The coaxial contact 121 is mounted to the holder 128 by placing a front end of the coaxial contact 121 on the guide 132 projecting from the rear surface of the holder 128 and inserting the coaxial contact 121 into the insertion hole 133 along the guide 132.

The protrusion 127 is fitted into and engages an inner wall of the window 131 when the coaxial contact 121 is inserted into a predetermined position of the insertion hole 133.

The movement of the coaxial contact 121 relative to the holder 128 in the X1 direction is constrained by fitting the protrusion 127 to the window 131. Thereby, the coaxial contact 121 is fixed to the holder 128.

The protrusion 127 can be displaced by inserting a jig into the window 131 when the protrusion 127 and the window 131 are engaged, and the protrusion 127 is released from the window 131. By pulling the coaxial contact 121 when the the protrusion 127 is released from the window 131, the coaxial contact 121 is removed from the holder 128.

The window 131 of the holder 128 and the window 113 of the plug body 101 are formed to face each other when the contact module 120 is mounted to the plug body 101. Therefore, the protrusion 127 can be released from the window 131 by inserting a jig into the window 113.

Accordingly, the coaxial contact 121 can be easily removed from the plug body 101 or the holder 128 by simply releasing the protrusion 127 from the window 131 by inserting a jig into the windows 113, 131 when it is necessary to remove the coaxial contact 121 from the plug body 101, or the holder 128. Further, the coaxial contact 121 can be mounted to the holder 128 by simply inserting the coaxial contact 121 into the holder 128.

With the plug connector 100 according to the above-described embodiment, the coaxial contact 121 can be easily attached to or detached from the holder 128. Therefore, an assembly process, a maintenance process or the like can be facilitated.

In the above-described embodiment, the holder 128 is mounted to the plug body 101 after the coaxial contact 121 is mounted to the holder 128. Alternatively, the holder 128 may be mounted to the plug body 101 beforehand, so that the coaxial contact 121 is mounted to the holder 128, which is already mounted to the connector body 101.

Figure 14:
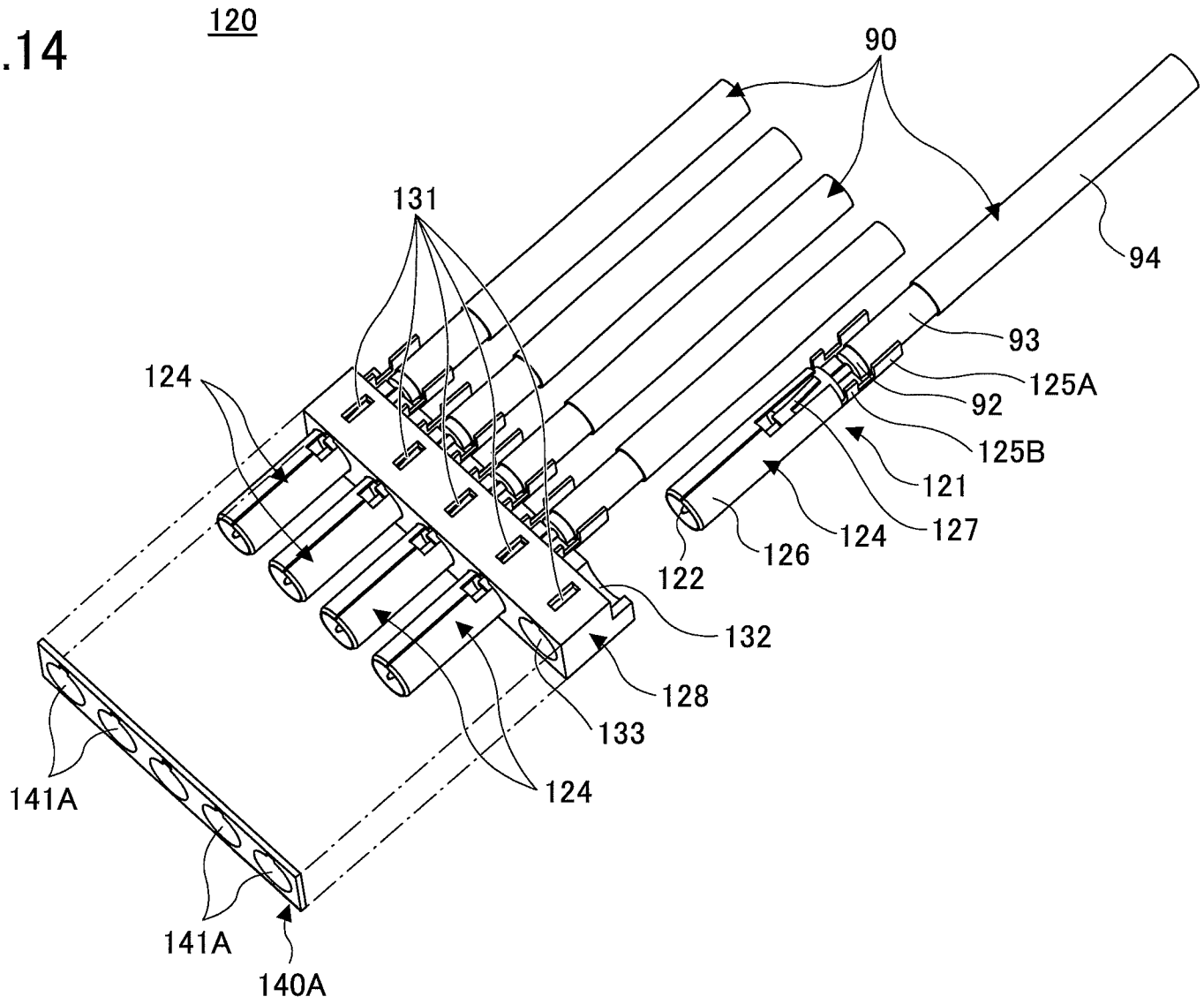
FIG. 14 is a perspective view illustrating the common ground member.
Figure 15:
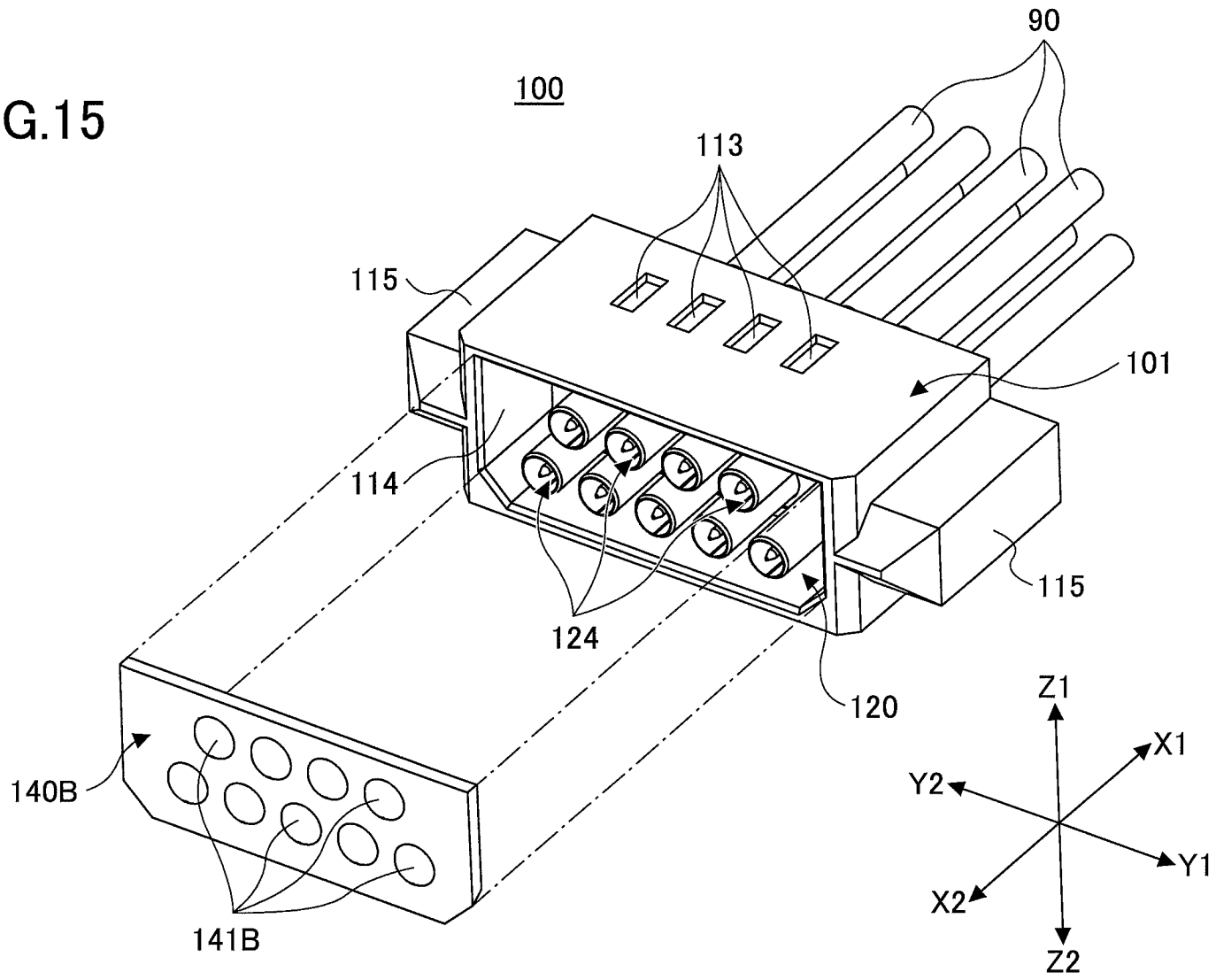
FIG. 15 is a perspective view illustrating the common ground member.

FIGS. 14 and 15 illustrate perspective views of a common ground member to be provided to the coaxial contact 121. In the embodiments illustrated in FIGS. 14 and 15, like components are denoted with like reference numerals as the reference numerals of FIGS. 11 to 13 and further explanation thereof is omitted.

In the plug connector 100 of FIG. 11 and the contact module 120 of FIG. 12, the ground contacts 124 of the coaxial contacts 121 are not shared and are provided separately.

In the contact module 120A of FIG. 14, a plate-like common ground member 140A formed of a conductive metal is provided on the front surface of the holder 128.

The common ground member 140A has holes 141A into which the ground contacts 124 projecting from the holder 128 are inserted. The ground contacts 124 are inserted into the holes 141A by mounting the common ground member 140A to holder 128. Each of the ground contacts 124 are commonly connected by the common ground member 140A.

FIG. 15 illustrates a common ground member 140B mounted to the plug body 101.

The common ground member 140B has holes 141B corresponding to the coaxial contacts 121 provided in the plug body 101. In this embodiment, four holes 141B are formed in an upper part of the common ground member 140A and five holes 141B are formed in a lower part of the common ground member 140A. Accordingly, nine ground contacts 124 can be commonly connected to have the same potential by mounting the common ground member 140B.

Figure 16:
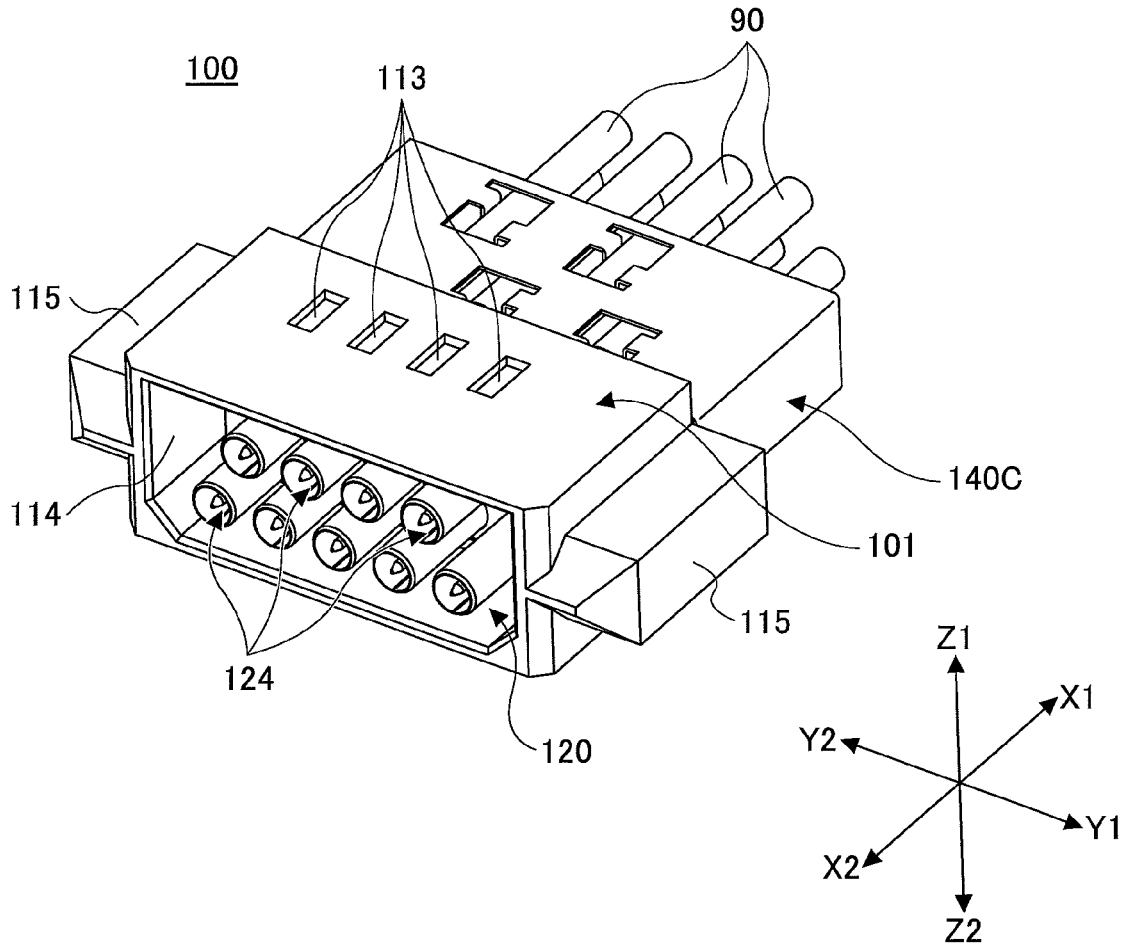
FIG. 16 is a perspective view illustrating the common ground member.

FIG. 16 illustrates a common ground member 140C provided at the rear of the plug body 101 for commonly connecting multiple ground contacts 124.

The position for commonly connecting the multiple ground contacts 124 is not limited to the front of the holder 128. In case of FIG. 12, the ground contacts 124 project from the rear of the holder 128. Thus, the ground contacts 124 may be commonly connected at the rear of the holder 128.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A connector comprising:

a contact that has a first end provided with a contact point for connecting to a coaxial cable, and a second end provided with a terminal for connecting to a substrate;

a body that includes a contact mount to which the contact is mounted and a substrate mount to which the substrate is mounted; and a bracket detachably attached to the body and including a slot into which the terminal is inserted;

wherein when the bracket is attached to the body, the terminal being inserted into the slot is applied with pressure from the bracket, so that the terminal applies pressure to the substrate and contacts the substrate.

2. The connector as claimed in claim 1, wherein the contact includes a first contact and a second contact, wherein the first contact is separated from the second contact in a direction in which the bracket is detached from the body, wherein the second contact includes a mounting part that is mounted to the slot, and wherein the mounting part includes a position defining part that defines the position of the terminal.

3. The connector as claimed in claim 1, wherein the terminal includes a target pressure part, and wherein the target pressure part is applied with the pressure from the bracket.

4. A connector comprising:

a contact module including a signal contact configured to connect with a center conductor of a coaxial cable, a ground contact that covers the signal contact and is configured to connect with an external conductor of the coaxial cable, and a holder including a mounting part to which the contact module is mounted;

wherein the holder includes a window communicating with the mounting part, and wherein the ground contact includes a fitting protrusion integrally formed with the ground contact, the fitting protrusion detachably attaching with the window when the contact module is mounted to the holder.

5. The connector as claimed in claim 4, further comprising:

a ground contact connection member configured to electrically connect with a plurality of ground contacts;

wherein a plurality of contact modules are mounted to the holder.

* * * * *